US005323887A

United States Patent [19]

Scicluna et al.

[11] Patent Number: 5,323,887

[45] Date of Patent: Jun. 28, 1994

[54] LUGGAGE CASE ON WHEELS

[75] Inventors: Paul V. Scicluna, Penndel; Marvin Schwartzstein, Rydal, both of Pa.

[73] Assignee: York Partners, L.P., Lambertville, N.J.

[21] Appl. No.: 903,349

[22] Filed: Jun. 24, 1992

[51] Int. Cl.[5] ..... A45C 5/14; A45C 13/26; B60B 33/00; A47B 91/00

[52] U.S. Cl. ..... 190/18 A; 190/115; 16/18 R; 16/18 C G; 16/45; 16/47; 280/37

[58] Field of Search ..... 190/18 R, 115; 16/18 R, 16/18 C G, 45, 47, 18 A; 280/37, 47, 371, DIG. 3

[56] References Cited

U.S. PATENT DOCUMENTS

| | | | |
|---|---|---|---|
| 2,228,066 | 1/1941 | Tashbook | 280/DIG. 3 X |
| 2,416,752 | 3/1947 | Hendrick | 190/18 A X |
| 2,465,847 | 3/1949 | Coffey | 280/DIG. 3 X |
| 2,510,754 | 6/1950 | Norlin | 280/38 |
| 3,522,955 | 8/1970 | Warner, Jr. | 190/18 AX |
| 3,540,752 | 11/1970 | Anuskiewicz et al. | 280/47.371 X |
| 3,606,372 | 9/1971 | Browning | 280/47.17 |
| 3,653,474 | 4/1972 | Sadow | 190/18 A |
| 3,655,215 | 4/1972 | Becklin | 190/18 A X |
| 3,762,739 | 10/1973 | Tabet | 280/47.371 |
| 3,797,067 | 3/1974 | Rodgers | 190/18 A X |
| 3,799,568 | 3/1974 | Hager | 190/18 A X |
| 3,818,542 | 6/1974 | Jones | 16/18 CG |
| 3,924,872 | 12/1975 | Sollazzi et al. | 190/18 A |
| 3,987,875 | 10/1976 | Szabo | 190/18 A |
| 4,024,600 | 5/1977 | Feinberg et al. | 190/18 A X |
| 4,168,558 | 9/1979 | Walker | 16/18 CG |
| 4,228,877 | 10/1980 | Cothary | 280/37 X |
| 4,261,447 | 4/1981 | Arias et al. | 190/18 A |
| 4,262,780 | 4/1981 | Samuelian | 190/18 A |
| 4,321,727 | 3/1982 | Sheiman et al. | 190/18 A X |
| 4,358,005 | 11/1982 | Fontana | 190/18 A |
| 4,385,415 | 5/1983 | Volz | 190/18 A X |
| 4,700,430 | 10/1987 | Raftery | 16/18 CG |
| 4,813,520 | 3/1989 | Lin | 190/18 AX |
| 4,890,705 | 1/1990 | Pineda | 190/18 A |
| 4,966,259 | 10/1990 | Bergman | 190/18 A |
| 5,024,455 | 6/1991 | Schrecongost | 280/37 |
| 5,048,649 | 9/1991 | Carpenter et al. | 190/18 A |
| 5,108,119 | 4/1992 | Huang | 280/37 |
| 5,116,289 | 5/1992 | Pond et al. | 190/18 A |
| 5,165,508 | 11/1992 | Kim | 190/115 |
| 5,178,244 | 1/1993 | Liang | 190/18 A |
| 5,207,440 | 5/1993 | Liang | 280/37 X |

FOREIGN PATENT DOCUMENTS

| | | | |
|---|---|---|---|
| 2258233 | 5/1974 | Fed. Rep. of Germany | 16/18 R |
| 1197511 | 12/1959 | France | 16/18 CG |
| 2454773 | 12/1980 | France | 190/18 A |
| 2661807 | 11/1991 | France | 190/18 A |
| 697220 | 10/1965 | Italy | 280/37 |
| 620513 | 3/1949 | United Kingdom | 280/37 |
| 1301488 | 12/1972 | United Kingdom | 280/37 |
| 2022997 | 12/1979 | United Kingdom | 190/18 A |

*Primary Examiner*—Sue A. Weaver
*Attorney, Agent, or Firm*—Shapiro and Shapiro

[57] ABSTRACT

A luggage case has a bottom wall supported on four swivel wheels that permit the luggage case to be turned in any direction about a vertical axis. Two of the swivel wheels are part of a leading wheel assembly, and two of the swivel wheels are part of a trailing wheel assembly. Each wheel assembly has a one-piece molded plastic base including an elongated plate extending transversely of the bottom wall of the luggage case and attached thereto, and a pair of downwardly open protective cups surrounding respective swivel wheels. A retractable handle system includes a fixed portion mounted on the top wall of the case, and a movable portion having a handle that may be extended and tilted upwardly for pulling the case along the ground.

11 Claims, 6 Drawing Sheets

LUGGAGE CASE ON WHEELS

This invention is concerned with an improved luggage case on wheels, more particularly a soft-sided luggage case that may be pulled with greater freedom of movement and stability than prior luggage cases on wheels.

BACKGROUND OF THE INVENTION

The popularity of wheeled luggage cases has spawned a multitude of wheel systems, such as, for example, a wheel system consisting of a pair of swivel wheels and a pair of non-swivel wheels at leading and trailing ends, respectively, of the bottom wall of a luggage case, so that the case may be moved along the ground by a pulling strap, and a wheel system consisting of a pair of non-swivel wheels at the trailing end of the bottom wall of a luggage case, so that the case may be pulled along the ground when the leading end of the bottom wall is lifted off of the ground by means of a rigid or semi-rigid pulling handle. Recently, a wheel system has been proposed that consists of a pair of major (larger) non-swivel wheels at opposite sides of the bottom wall of a luggage case centered between leading and trailing end walls, and a single minor (smaller) swivel wheel mounted at each end of the bottom wall centered between the side walls. With such a wheel system, a luggage case may be turned freely about a central vertical axis when the case is pulled by means of a handle at one end of the case.

All of the conventional wheel systems have disadvantages. For example, a wheel system constituted by two swivel wheels and two non-swivel wheels provides limited freedom of movement, and luggage cases employing such wheel systems tend to be unstable when pulled. A wheel system constituted by two non-swivel wheels requires that a user support part of the weight of the luggage case when the case is pulled. A wheel system constituted by two major non-swivel wheels disposed at opposite sides of the bottom wall centered between the end walls and two minor swivel wheels at opposite ends of the bottom wall supports a luggage case on only three wheels (the major wheels and one minor wheel) at any given time, an arrangement that is less stable in certain respects than wheel systems employing four wheels adjacent to respective corners of the bottom wall. Also, the rather large major wheels require a special case construction to accommodate them.

BRIEF DESCRIPTION OF THE INVENTION

The present invention provides a luggage case having greater freedom of movement, and, at the same time, greater stability, than prior luggage cases. The invention employs an improved wheel system that is used in conjunction with an improved retractable handle system.

More particularly, the wheel system comprises leading and trailing wheel assemblies, each of which includes a one-piece molded plastic base on which a pair of swivel wheels are mounted. Each base has an elongated plate extending transversely of and attached to an end of the bottom wall of a luggage case, and has a pair of downwardly open protective cups surrounding respective swivel wheels. Each cup has a side wall with a lower-most edge that is D-shaped in a horizontal plane. Straight side wall portions of each pair of cups are adjacent to one another and are disposed longitudinally of the bottom wall of the luggage case. The retractable handle system includes a fixed portion mounted interiorly on the top wall of a luggage case and a movable portion that may be extended from the fixed portion and tilted upwardly.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

Figure 1:
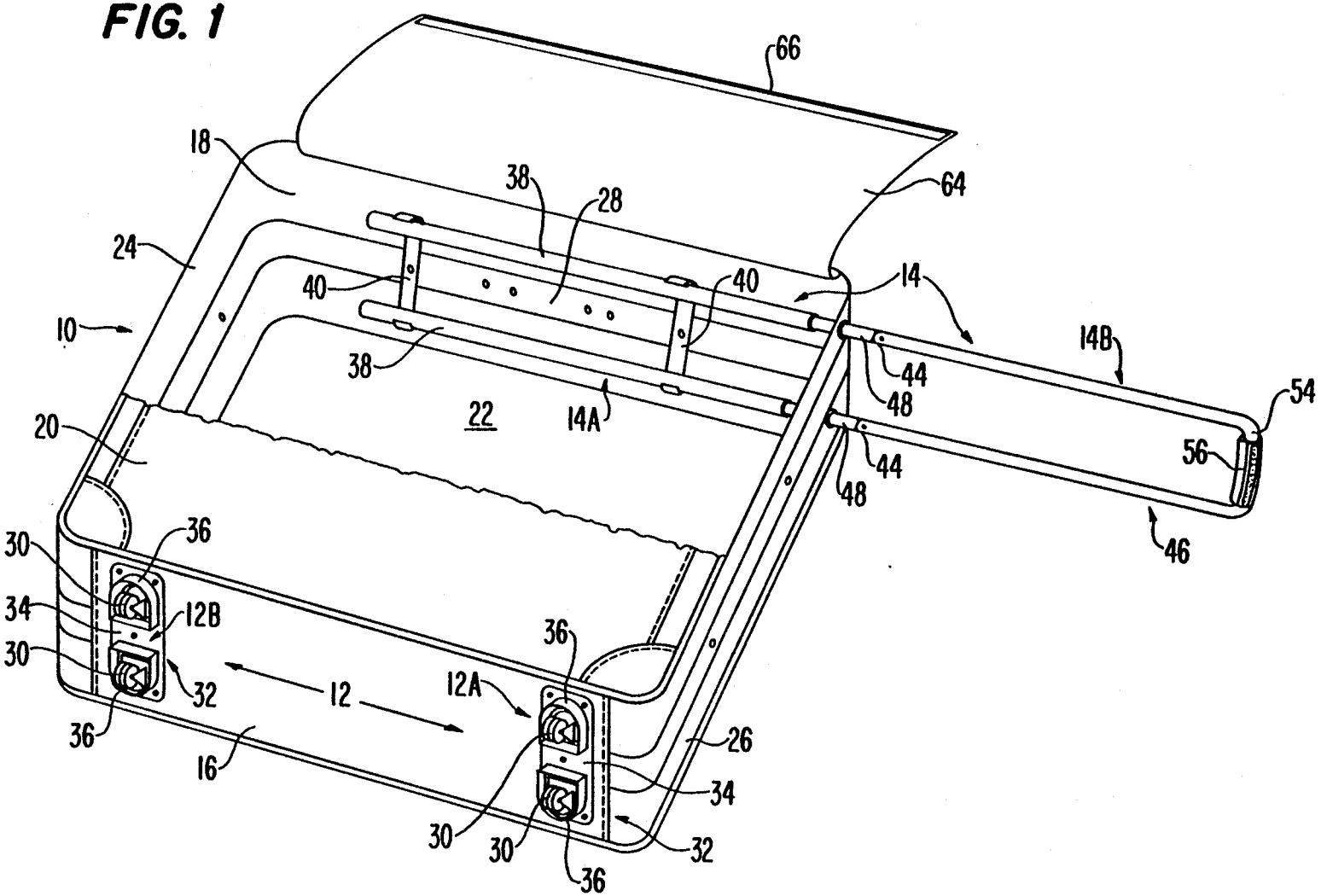
FIG. 1 is a perspective view, partially broken away, of a luggage case in accordance with the invention.

FIG. 1 shows a soft-sided luggage case 10 incorporating a wheel system 12 and a handle system 14 in accordance with the invention. The luggage case per se is conventional and includes a bottom wall 16, a top wall 18, side walls 20 and 22, and end walls 24 and 26 supported on a frame 28, only part of which is shown. As is apparent in FIG. 1, the side walls 20 and 22 are the major walls of the case 10, and the remaining walls are minor walls. In other words, the cross-dimensions of the side walls 20 and 22 are substantially greater than the distance between the side walls. To open the case a zipper (not shown) is conventionally provided along edges of one of the side walls (e.g., 20).

In accordance with the invention, the luggage case is supported on a wheel system 12 including two wheel assemblies 12A and 12B (leading and trailing, respectively) mounted on the bottom wall 16 at opposite ends thereof. Each wheel assembly has a pair of swivel wheels 30 adjacent to respective corners of the bottom wall. Each pair of swivel wheels is mounted on a one-piece molded plastic base 32 that includes an elongated rectangular plate 34 and a pair of downwardly open protective cups 36. By virtue of the four swivel wheels, the luggage case, when supported on the ground by the wheels, can be turned freely in any direction about a vertical (yaw) axis extending centrally through the top and bottom walls, unlike luggage cases supported on a pair of swivel wheels at one end of the bottom wall and a pair of non-swivel wheels at the opposite end. With such a high degree of freedom in a luggage case having the configuration described earlier, it is particularly important, for stability, to provide a suitable handle system for pulling the case along the ground.

In accordance with the invention, a retractable handle system 14 is provided, comprising a fixed portion 14A mounted interiorly of the case on the top wall 18 (more specifically on the frame at the top wall) and a movable portion 14B adapted to be moved between a retracted position in which the movable portion is predominantly inside the case, and an extended position in which the movable portion is predominantly outside the case.

Figure 2:
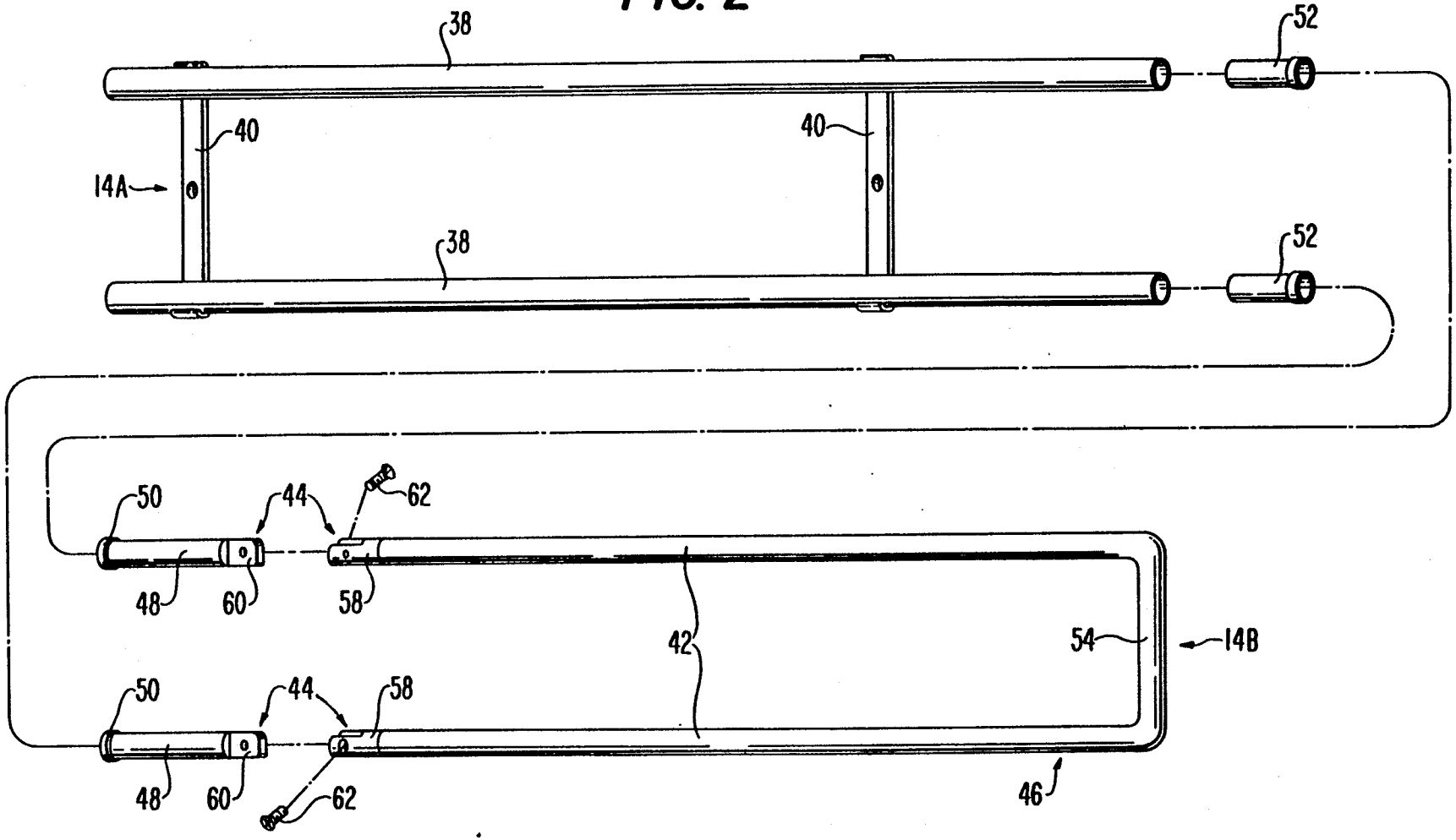
FIG. 2 is an exploded perspective view of a handle system employed in the invention.

As shown in FIGS. 1 and 2, the fixed portion 14A has a pair of parallel elongated guide members 38, such as cylindrical tubes, fixed adjacent to the side walls 20 and 22, respectively, to a pair of bars 40 that span the distance between the guide members and that are riveted or otherwise attached to the frame. The movable portion 14B is U-shaped and has parallel elongated legs 42, such as cylindrical rods that are adapted to telescope into the guide members 38.

The legs 42 of the movable portion 14B are articulated by means of hinges 44 that permit a handle 46 to tilt upwardly relative to stem parts 48 that are held within the guide members 38 by means of flanges 50 that engage the inner ends of bushings 52 mounted within and fixed to the respective guide members. The fit between the legs and the bushings, and between the flanges and the inner surface of the guide members, provides smooth sliding of the movable portion 14B of the handle system within the fixed portion 14A, with sufficient friction to maintain the retracted position of the handle 46 except when it is desired to extend the handle.

Figure 5:
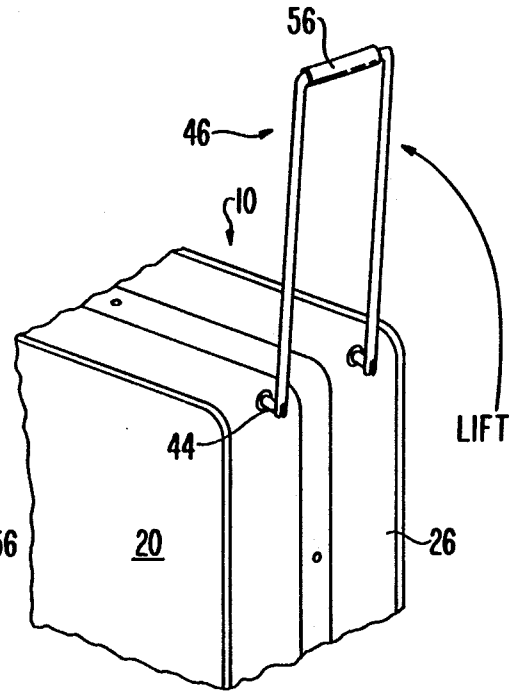
FIGS. 3–5 are fragmentary perspective views illustrating the utilization of the handle system.
Figure 4:
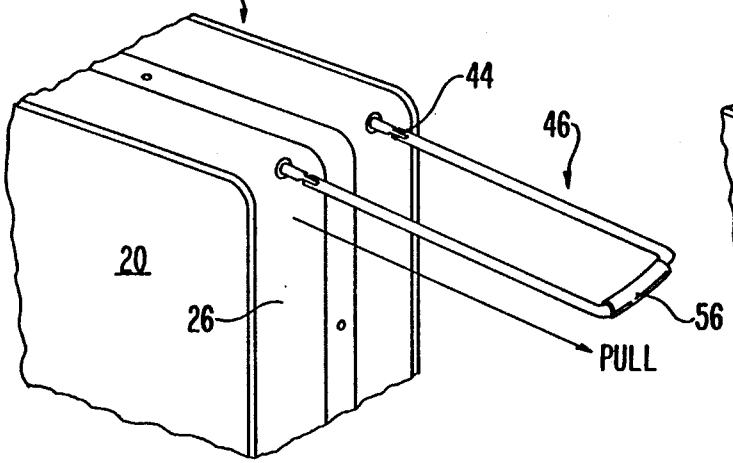
Figure 3:
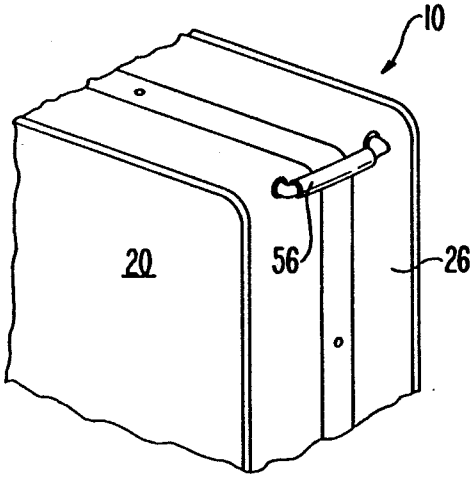
Figure 6:
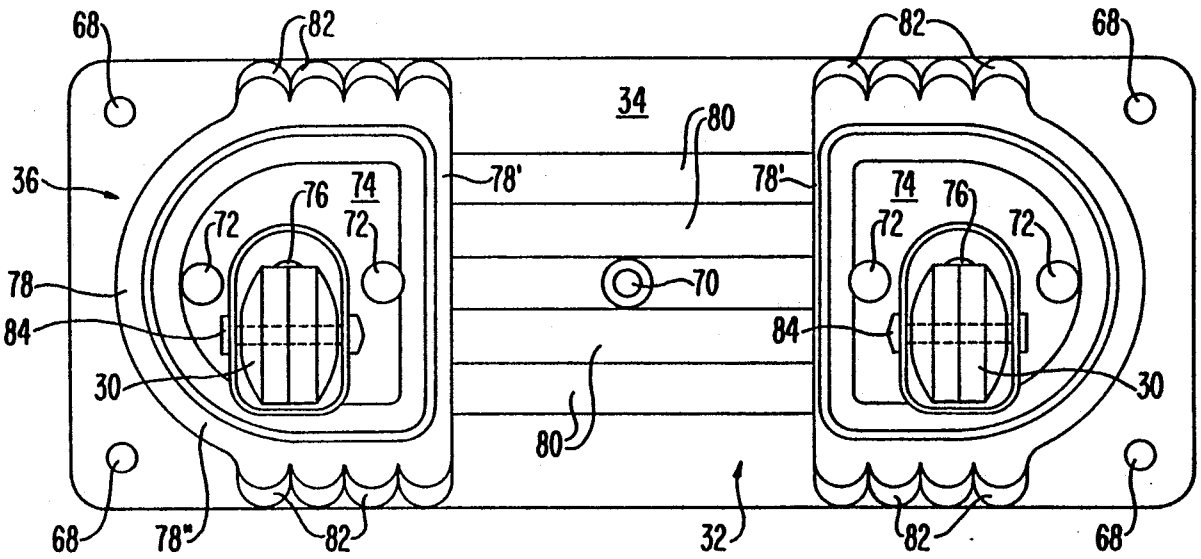
FIGS. 6–8 are, respectively, a bottom plan view, a rear elevation view, and an end elevation view of a wheel assembly in accordance with the invention.
Figure 7:
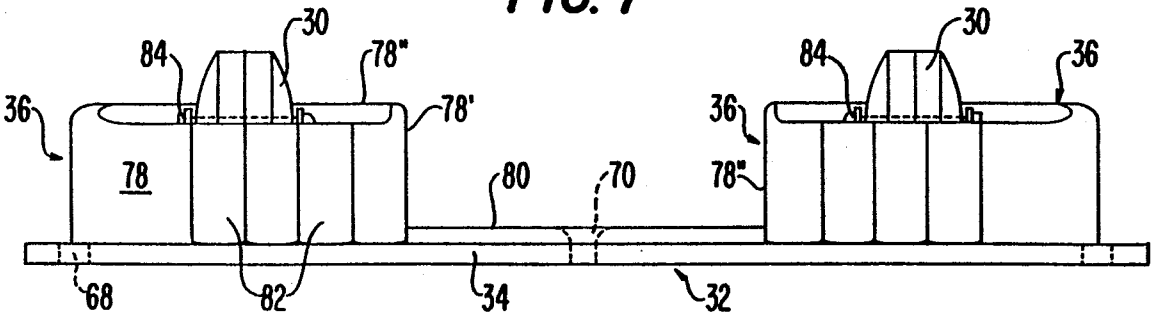
Figure 8:
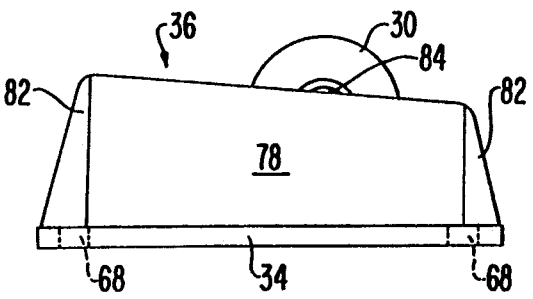
Figure 9:
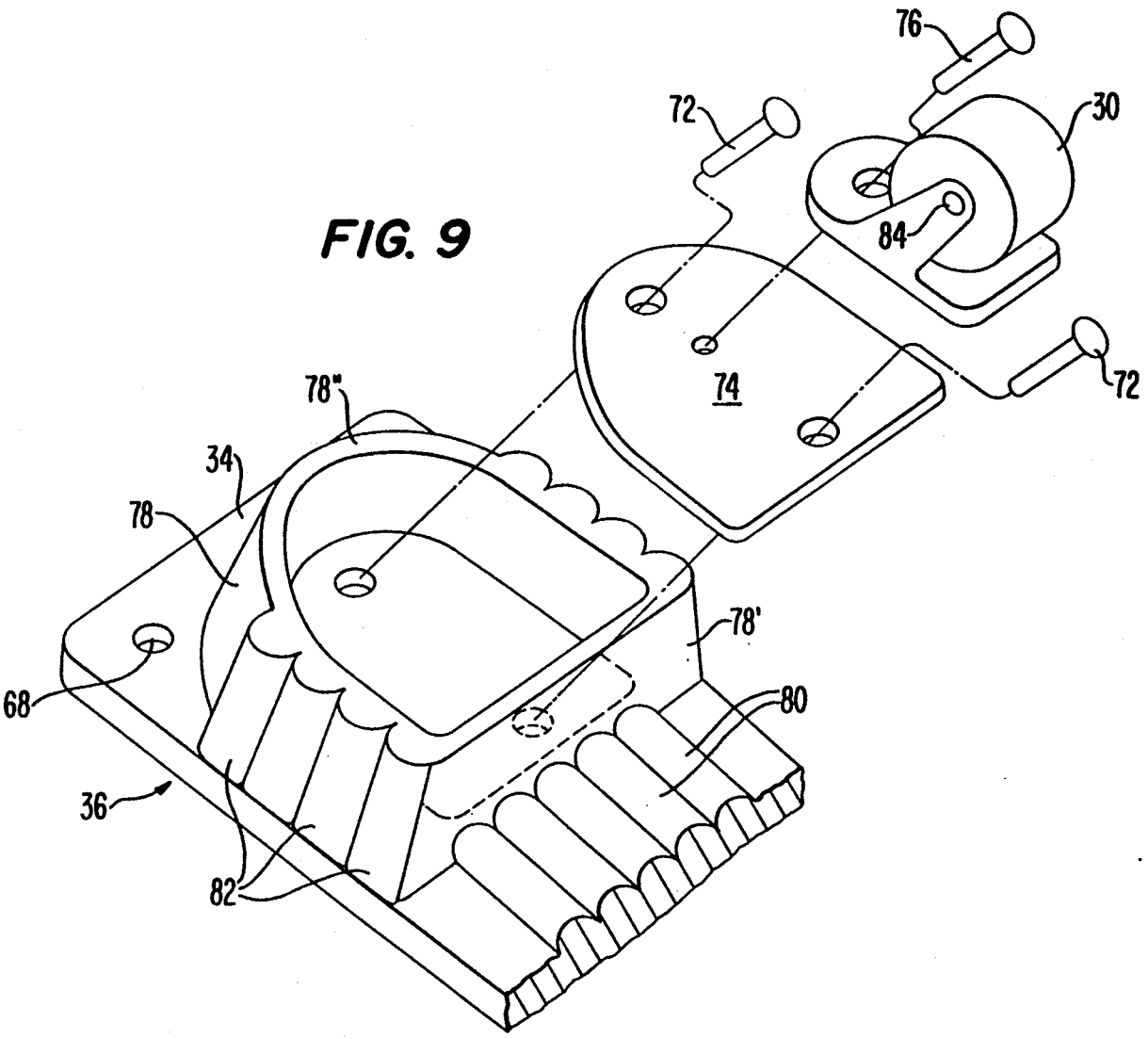
FIG. 9 is a fragmentary exploded perspective view illustrating a portion of a wheel assembly.
Figure 10:
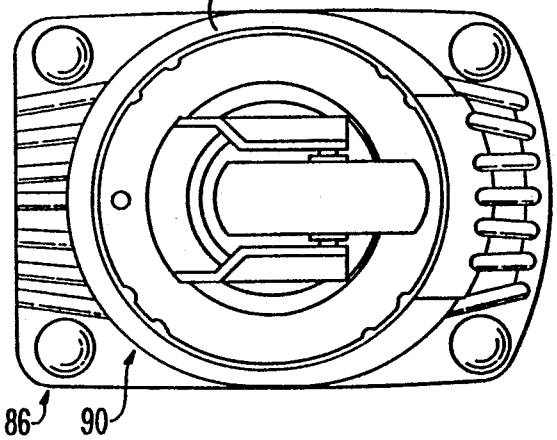
FIG. 10 (PRIOR ART)
FIGS. 10–13 are, respectively, a bottom plan view, a side elevation view, a front elevation view, and a rear elevation view of a prior art wheel assembly.
Figure 11:
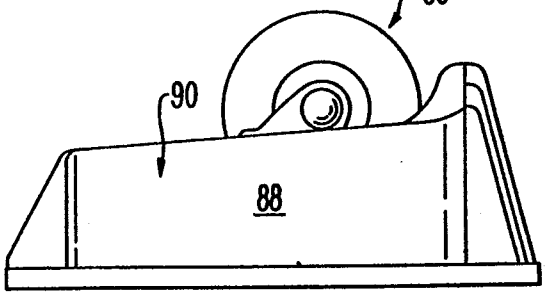
FIG. 11 (PRIOR ART)
Figure 12:
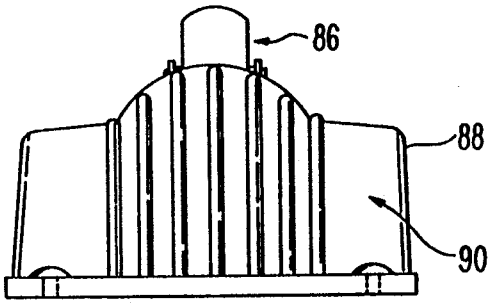
FIG. 12 (PRIOR ART)
Figure 13:
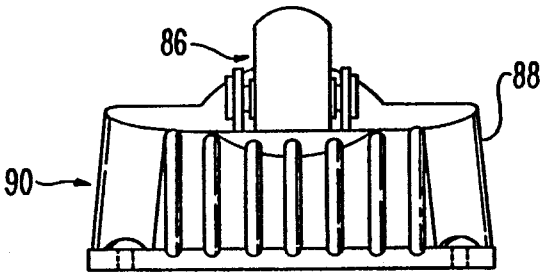
FIG. 13 (PRIOR ART)

As shown in FIG. 1, the bight 54 of the handle is provided with a padded sleeve 56 (not shown in FIG. 2), which is grasped by the user to pull the handle 46 from the fully retracted position shown in FIG. 3 (in which the sleeve 56 is against an end wall 26 of the case), to the fully extended position shown in FIG. 4, and then to lift the handle upwardly, as shown in FIG. 5, to a position at which the handle is disposed for convenient pulling of the luggage case 10 along the ground.

The hinges 44 are designed so that the handle may be tilted upwardly, but not downwardly, from the position shown in FIG. 4. As shown in FIG. 2, each hinge may include a slotted part 58 into which a flattened end 60 of a stem part 48 is fitted and held by means of a pivot screw 62. Only the upper corner of the flattened end 60 is curved, so that the handle cannot tilt downwardly.

The handle system of the invention is simple in construction and is easy to manufacture and install. As shown in FIG. 1, a flexible flap 64 having a Velcro strip 66 along one edge thereof may be provided to cover the fixed portion of the handle system.

Despite its simplicity, the handle system of the invention, when used in conjunction with the four swivel wheels of the wheel system of the invention, provides the desired stability when a luggage case is pulled along the ground. Although the handle is tiltable upwardly when extended, it is rigid with regard to both movement of the luggage case around its vertical (yaw) axis and with regard to movement of the luggage case around a horizontal (roll) axis extending along the bottom wall longitudinally of the luggage case and perpendicular to its vertical axis. The location of the handle system along the top wall of the luggage case assists in resisting any tendency of the luggage case to flip over onto one of its sides. Also, the handle permits the leading end of the case to be lifted over a curb, for example.

Turning now in greater detail to the wheel assemblies 12A and 12B of the invention, which are identical, and one of which is shown in FIGS. 6–9, the elongated base plate 34 of each wheel assembly is generally rectangular and is provided with a hole 68 at each corner and a hole 70 at the center of the plate, which receive rivets or screws for attaching the plate to the bottom wall 16 of the luggage case 10. Each swivel wheel 30 is mounted on the base plate 34 of a wheel assembly by means of rivets 72 (or screws) extending through a mounting plate 74 of the swivel wheel, on which the wheel freely swivels about the vertical axis of a rivet 76 without restriction. The base 32 of each wheel assembly is preferably molded of nylon or other suitable plastic having considerable rigidity, not only to provide the desired strength of the wheel assembly, but also to stiffen the bottom wall of the luggage case near its leading and trailing ends.

Each protective cup 36 has a side wall 78 that is D-shaped in a horizontal plane. Straight portions 78' of the side walls of each pair of associated cups extend transversely of the base plate (longitudinally of the bottom wall of the luggage case) adjacent to one another, but spaced apart as shown. The central portion of each base plate between the cups has stiffening ribs 80. Similar ribs 82 (but tapered) are provided at leading and trailing portions of the side wall 78 of each cup. The side wall of each cup extends downwardly almost to the horizontal axle 84 of each swivel wheel. The lowermost edge 78" of the side wall forms a surface that is inclined relative to the base plate, so that the leading portion of the side wall is of greater height than the trailing portion, increasing the protection of the swivel wheels where they are most vulnerable to impact during pulling of the luggage case.

The unitary construction of each wheel assembly including a pair of swivel wheels provides additional strength to the wheel assembly and ease of installation on a luggage case. Moreover, a mold for manufacturing each wheel assembly can readily be modified to produce wheel assemblies with different spacing between swivel wheels (for luggage cases of different width) by cutting the mold centrally across the ribs 80 and hole 70.

FIGS. 10–13 illustrate a prior art swivel wheel assembly 86 used on a luggage case as a pair, together with a pair of non-swivel wheel assemblies. Each wheel assembly must be individually manufactured and installed, and the individual wheel assemblies provide no significant stiffening of the bottom wall of a luggage case. Also, the circular side wall 88 of the protective cup 90 of each individual wheel assembly lacks the ability of the straight wall portions 78' of the side walls of the wheel assemblies of the invention, which strongly resist impact applied longitudinally of the bottom wall of the luggage case along the length of the straight side wall portions.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. A luggage case comprising a pair of side walls, a pair of end walls, a bottom wall, and a top wall, the cross-dimensions of the side walls being substantially greater than the distance between the side walls, the bottom wall having four swivel wheels mounted thereon adjacent to respective corners thereof, whereby the luggage case may be supported on the ground and freely turned in any direction about a central vertical axis, the top wall having a handle system mounted thereon, the handle system including an elongated fixed portion within the luggage case attached to the top wall longitudinally and an elongated movable portion and including means for longitudinally sliding the movable portion horizontally on and relative to the fixed portion between a retracted position in which the length of the movable portion is predominantly inside of the luggage case and an extended position in which the length of the movable portion is predominantly outside of the luggage case, the movable portion including hinge means for permitting a handle part of the movable portion to be tilted upwardly relative to a stem part of the movable portion when the movable portion is in its extended position, wherein the fixed portion of the handle system comprises a pair of parallel elongated guide members adjacent to the side walls, respectively, and the movable portion of the handle system is U-shaped and includes a pair of parallel elongated legs that telescope with the guide members and a bight that is positioned adjacent to an end wall of the luggage case externally when the movable portion is in its retracted position and that is adapted to be grasped by a user to move the movable portion to its extended position and to tilt the handle part upwardly for pulling the luggage case along the ground.

2. A luggage case according to claim 1, wherein the hinge means is constructed to prevent downward tilting of the handle part.

3. A luggage case comprising a pair of side walls, a pair of end walls, a bottom wall, and a top wall, the cross-dimensions of the side walls being substantially greater than the distance between the side walls, the bottom wall having four swivel wheels mounted thereon adjacent to respective corners thereof, whereby the luggage case may be supported on the ground and freely turned in any direction about a central vertical axis, the top wall having a handle system mounted thereon, the handle system including an elongated fixed portion within the luggage case attached to the top wall longitudinally and an elongated movable portion and including means for longitudinally sliding the movable portion horizontally on and relative to the fixed portion between a retracted position in which the length of the movable portion is predominantly inside of the luggage case and an extended position in which the length of the movable portion is predominantly outside of the luggage case, the movable portion including hinge means for permitting a handle part of the movable portion to be tilted upwardly relative to a stem part of the movable portion when the movable portion is in its extended position; wherein two of the swivel wheels are part of a leading wheel assembly and two of the swivel wheels are part of a trailing wheel assembly, each wheel assembly comprising a one-piece molded plastic base including an elongated plate extending transversely of and attached to the bottom wall of the luggage case and a pair of downwardly open protective cups surrounding respective swivel wheels.

4. A luggage case according to claim 3, wherein each cup has a side wall that is D-shaped in a horizontal plane, with a straight wall portion disposed longitudinally of the bottom wall of the luggage case, the straight wall portions of each wheel assembly being adjacent to one another.

5. A luggage case according to claim 4, wherein the side wall of each cup has a lower-most edge that is inclined relative to the plate of the corresponding wheel assembly so that the height of the side wall is greater adjacent to a leading edge of the plate than adjacent to a trailing edge of the plate.

6. A luggage case according to claim 4, wherein each plate has stiffening ribs extending between the adjacent straight side wall portions of associated cups.

7. A wheel assembly for a luggage case, comprising a pair of swivel wheels mounted on a one-piece molded plastic base including an elongated plate and a pair of downwardly open protective cups surrounding respective swivel wheels, each cup having a side wall that is D-shaped in a plane parallel to the plate, with a straight wall portion disposed transversely of the plate, the straight wall portions being parallel and adjacent to one another.

8. A wheel assembly according to claim 7, wherein the side wall of each cup has a lower-most edge that is inclined relative to the plate so that the height of the side wall is greater adjacent to a leading edge of the plate than adjacent to a trailing edge of the plate.

9. A wheel assembly according to claim 7, wherein said plate has stiffening ribs extending between the adjacent straight side wall portions.

10. A soft-sided luggage case comprising a pair of side walls, a pair of end walls, a bottom wall, and a top wall, the cross-dimensions of the side walls being substantially greater than the distance between the side walls, the luggage case having a frame including a frame part extending longitudinally of the top wall, the bottom wall having four wheels mounted thereon adjacent to respective corners thereof, the frame part of the top wall having a handle system mounted thereon, the handle system including an elongated fixed portion within the luggage case attached to the frame part of the top wall longitudinally and an elongated movable portion and including means for longitudinally sliding the movable portion horizontally on and relative to the fixed portion between a retracted position in which the length of the movable portion is predominantly inside of the luggage case and an extended position in which the length of the movable portion is predominantly outside of the luggage case, the movable portion including hinge means for permitting a handle part of the movable portion to be tilted upwardly relative to a stem part of the movable portion when the movable portion is in its extended position; wherein the fixed portion of the handle system comprises a pair of parallel elongated guide members adjacent to the side walls, respectively, and the movable portion of the handle system is U-shaped and includes a pair of parallel elongated legs that telescope with the guide members and a bight that is positioned adjacent to an end wall of the luggage case externally when the movable portion is in its retracted position and that is adapted to be grasped by a user to move the movable portion to its extended position and to tilt the handle part upwardly for pulling the luggage case along the ground.

11. A luggage case according to claim 10, wherein the hinge means is constructed to prevent downward tilting of the handle part.

* * * * *